US009345371B2

(12) United States Patent
Morphey et al.

(10) Patent No.: US 9,345,371 B2
(45) Date of Patent: May 24, 2016

(54) VACUUM CLEANER BASE ASSEMBLY

(71) Applicant: ELECTROLUX HOME CARE PRODUCTS, INC., Charlotte, NC (US)

(72) Inventors: John Curtis Morphey, Concord, NC (US); Alexander Douglas Goare, Charlotte, NC (US); Donald Joseph Davidshofer, Mount Holly, NC (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 593 days.

(21) Appl. No.: 13/712,512

(22) Filed: Dec. 12, 2012

(65) Prior Publication Data

US 2014/0157541 A1 Jun. 12, 2014

(51) Int. Cl.

| | |
|---|---|
| ***A47L 9/00*** | (2006.01) |
| ***A47L 5/28*** | (2006.01) |
| ***A47L 9/32*** | (2006.01) |
| ***A47L 9/02*** | (2006.01) |
| ***A47L 9/22*** | (2006.01) |

(52) U.S. Cl.

CPC ..... *A47L 5/28* (2013.01); *A47L 9/0009* (2013.01); *A47L 9/02* (2013.01); *A47L 9/22* (2013.01); *A47L 9/32* (2013.01); *A47L 9/325* (2013.01)

(58) Field of Classification Search

CPC ..... A47L 9/00; A47L 9/32; A47L 9/325; A47L 5/00; A47L 5/34; A47L 9/009; A47L 5/28

USPC ..... 15/410

See application file for complete search history.

(56) References Cited

U.S. PATENT DOCUMENTS

| | | | |
|---|---|---|---|
| 2,039,861 | A | 5/1936 | Watts |
| 2,103,101 | A | 12/1937 | Taylor |
| 2,289,711 | A | 7/1942 | Kirby |
| 2,381,710 | A | 8/1945 | Arnhym |

(Continued)

FOREIGN PATENT DOCUMENTS

| | | |
|---|---|---|
| CN | 1493245 | 5/2004 |
| CN | 1611173 | 5/2005 |

(Continued)

OTHER PUBLICATIONS

Combined Search and Examination Report for International Application No. GB1306707.9 dated Aug. 20, 2013.

(Continued)

*Primary Examiner* — Bryan R Muller
(74) *Attorney, Agent, or Firm* — RatnerPrestia

(57) ABSTRACT

A vacuum cleaner having base and handle assemblies. The base has a bottom face, left and right side regions, an opening between the left and right side regions, and a resiliently-deformable crossbeam extending across the opening. The handle is at least partially in the opening and pivotally mounted to the base. The handle is rotatable, relative to the base, between upright and reclined positions. A protrusion extends from the handle and rotates through an arc that intersects the crossbeam. The protrusion contacts one side of the crossbeam when the handle is upright, and is on another side of and spaced from the crossbeam when the handle is reclined. The protrusion deforms the crossbeam when the protrusion is moved past the crossbeam. The cleaner also has a suction inlet on the base, a suction source, a dirt collector, and air passages connecting the suction inlet, suction source and dirt collector.

21 Claims, 10 Drawing Sheets

(56) References Cited

U.S. PATENT DOCUMENTS

| | | | | |
|---|---|---|---|---|
| 2,409,082 | A | 10/1946 | Troxler | |
| 2,416,420 | A | 2/1947 | Taylor | |
| 2,446,985 | A | 8/1948 | Shumaker | |
| 2,581,962 | A | 1/1952 | Langille et al. | |
| 2,583,054 | A | 1/1952 | Kirby | |
| 2,672,643 | A | 3/1954 | Langille | |
| 2,753,585 | A | 7/1956 | Eberhart | |
| 2,850,757 | A | 9/1958 | Duff | |
| 2,881,465 | A | 4/1959 | Duff | |
| 2,898,621 | A | 8/1959 | Vance | |
| 2,898,622 | A * | 8/1959 | Hurd | 15/333 |
| 3,002,217 | A | 10/1961 | Smithson et al. | |
| 3,012,267 | A | 12/1961 | Kemnitz | |
| 3,031,710 | A | 5/1962 | Huening, Jr. | |
| 3,039,129 | A | 6/1962 | Belicka et al. | |
| 3,199,138 | A | 8/1965 | Nordeen | |
| 3,217,351 | A | 11/1965 | Hayba | |
| 3,512,207 | A | 5/1970 | Ettridge | |
| 3,618,687 | A | 11/1971 | Ripple et al. | |
| 3,639,941 | A | 2/1972 | Kirwan et al. | |
| 3,675,268 | A | 7/1972 | Nordeen | |
| 3,676,892 | A | 7/1972 | Nordeen | |
| 3,683,449 | A * | 8/1972 | Nordeen | A47L 9/325 15/410 |
| 3,802,026 | A | 4/1974 | Crener | |
| 3,821,831 | A | 7/1974 | Grover | |
| 3,827,103 | A | 8/1974 | Nordeen et al. | |
| 3,855,666 | A | 12/1974 | Erikson et al. | |
| 3,932,912 | A | 1/1976 | Johnson | |
| 3,952,363 | A | 4/1976 | Lindman | |
| 4,014,068 | A | 3/1977 | Payne et al. | |
| 4,078,275 | A | 3/1978 | Baird | |
| 4,167,799 | A | 9/1979 | Webb | |
| 4,171,554 | A | 10/1979 | Tschudy | |
| 4,174,554 | A | 11/1979 | Flantua | |
| 4,180,887 | A | 1/1980 | Wudel et al. | |
| 4,376,322 | A | 3/1983 | Lockhart et al. | |
| 4,423,534 | A | 1/1984 | Lyman et al. | |
| 4,446,594 | A | 5/1984 | Watanabe et al. | |
| 4,573,236 | A | 3/1986 | Dyson | |
| 4,592,111 | A | 6/1986 | Berfield | |
| 4,593,429 | A | 6/1986 | Dyson | |
| 4,782,552 | A | 11/1988 | Bartlett et al. | |
| 5,042,109 | A | 8/1991 | Stephens | |
| 5,086,538 | A | 2/1992 | Zahuranec | |
| 5,255,411 | A * | 10/1993 | Da Costa | A47L 5/34 15/333 |
| 5,269,042 | A | 12/1993 | Stephens et al. | |
| 5,347,678 | A | 9/1994 | Williams et al. | |
| 5,353,471 | A | 10/1994 | Gühne et al. | |
| 5,475,893 | A | 12/1995 | Sepke | |
| 5,551,120 | A | 9/1996 | Cipolla et al. | |
| 5,819,370 | A | 10/1998 | Stein | |
| 5,906,024 | A | 5/1999 | Jailor et al. | |
| 5,970,576 | A | 10/1999 | Maurer et al. | |
| 5,974,625 | A | 11/1999 | Garner | |
| 6,006,401 | A | 12/1999 | Jailor et al. | |
| 6,081,963 | A | 7/2000 | Jailor et al. | |
| 6,123,779 | A | 9/2000 | Conrad et al. | |
| 6,131,238 | A | 10/2000 | Weber et al. | |
| 6,134,744 | A | 10/2000 | Kasen et al. | |
| 6,146,434 | A | 11/2000 | Scalfani et al. | |
| 6,158,084 | A | 12/2000 | Weber et al. | |
| 6,243,917 | B1 | 6/2001 | Conrad | |
| 6,261,379 | B1 | 7/2001 | Conrad et al. | |
| 6,391,095 | B1 | 5/2002 | Conrad et al. | |
| 6,571,424 | B2 | 6/2003 | Roschi et al. | |
| 6,591,447 | B2 | 7/2003 | Wegelin et al. | |
| 6,772,474 | B2 | 8/2004 | Nishikori et al. | |
| 6,934,993 | B1 | 8/2005 | Huffman et al. | |
| 6,957,473 | B2 | 10/2005 | Nishikori et al. | |
| RE39,304 | E | 9/2006 | Kasen et al. | |
| 7,203,993 | B2 | 4/2007 | Tondra et al. | |
| 7,246,405 | B2 | 7/2007 | Yan | |
| 7,246,407 | B2 | 7/2007 | Park et al. | |
| 7,266,861 | B2 | 9/2007 | Stein et al. | |
| 7,290,308 | B2 | 11/2007 | Downey et al. | |
| 7,310,855 | B2 | 12/2007 | Blocker et al. | |
| 7,340,798 | B2 | 3/2008 | Nishikori et al. | |
| 7,350,266 | B2 | 4/2008 | Park et al. | |
| 7,353,563 | B2 | 4/2008 | Blocker et al. | |
| 7,549,190 | B2 | 6/2009 | Oh et al. | |
| 7,599,758 | B2 | 10/2009 | Reindle et al. | |
| 7,676,883 | B2 | 3/2010 | Macleod et al. | |
| 7,797,792 | B2 | 9/2010 | Cipolla et al. | |
| 7,895,707 | B2 | 3/2011 | Moon | |
| 7,921,509 | B2 | 4/2011 | Oh et al. | |
| 8,037,571 | B2 | 10/2011 | Butts et al. | |
| 8,060,980 | B2 | 11/2011 | Mayes et al. | |
| 8,082,624 | B2 | 12/2011 | Myers | |
| 8,387,206 | B2 | 3/2013 | Arthey et al. | |
| 8,387,207 | B2 | 3/2013 | Dimbylow et al. | |
| 8,448,295 | B2 | 5/2013 | Vines et al. | |
| 8,510,908 | B2 | 8/2013 | Maguire et al. | |
| 8,539,636 | B2 | 9/2013 | White et al. | |
| 8,631,541 | B2 | 1/2014 | Tran | |
| 2006/0005350 | A1 | 1/2006 | Kim | |
| 2006/0070209 | A1 | 4/2006 | Fischer et al. | |
| 2007/0245514 | A1 * | 10/2007 | Luebbering | A47L 5/32 15/410 |
| 2008/0289141 | A1 | 11/2008 | Oh et al. | |
| 2009/0276975 | A1 | 11/2009 | Vines | |
| 2009/0307867 | A1 | 12/2009 | Bernard et al. | |
| 2010/0236019 | A1 | 9/2010 | Behrenswerth | |
| 2012/0124769 | A1 | 5/2012 | Krebs et al. | |

FOREIGN PATENT DOCUMENTS

| | | |
|---|---|---|
| CN | 101961225 | 2/2011 |
| DE | 19632800 | 5/2011 |
| DE | 10305276 | 6/2013 |
| EP | 0792612 | 9/1997 |
| EP | 0793938 | 1/2003 |
| EP | 1396222 | 4/2010 |
| GB | 506512 | 5/1939 |
| GB | 584413 | 1/1947 |
| GB | 1320191 | 6/1973 |
| GB | 2336992 | 11/1999 |
| JP | 06292646 | 10/1994 |
| JP | 08280586 | 10/1996 |
| JP | 08299230 | 11/1996 |
| JP | 2000279353 | 10/2000 |
| JP | 2009112434 | 5/2009 |
| KR | 20040100146 | 12/2004 |

OTHER PUBLICATIONS

Fantom Fury Parts Manual. Undated, but admitted to be prior art.
Combined Search and Examination Report for GB1306707.9 dated Aug. 20, 2013.
Office Action mailed Jun. 8, 2015 for U.S. Appl. No. 13/789,895.
Entire patent prosecution history of U.S. Appl. No. 13/789,895, filed Mar. 8, 2013, entitled, "Vacuum Cleaner Base Assembly."
Entire patent prosecution history of U.S. Appl. No. 14/014,973, filed Aug. 30, 2013, entitled, "Vacuum Cleaner Air Passage System."
Office Action mailed Nov. 18, 2015 for U.S. Appl. No. 13/789,895.

* cited by examiner

VACUUM CLEANER BASE ASSEMBLY

BACKGROUND OF THE INVENTION

1. Field of the Invention

The present invention relates to upright vacuum cleaners having a base to which a handle is pivotally mounted. In particular respects, the disclosure relates to handle locking features and the arrangement and operation of the various parts of the base.

2. Description of the Related Art

Vacuum cleaners have been provided in a variety of configurations. One common type is the upright vacuum cleaner, which has a base that moves on the floor, and a handle pivotally mounted to the base. The base includes a suction inlet that faces the floor. A vacuum fan and motor assembly ("suction motor") is located in either the base or the handle, and fluidly connected to the inlet to generate a suction flow of air to draw in dirt and debris. A dirt collection device, such as a filter bag or inertial (e.g. cyclonic) separator, is provided in base or, much more frequently, in the handle. In use, the handle is leaned back and manipulated to direct the base over the floor in a series of back-and-forth motions. The upright vacuum cleaner is stored by pivoting the handle to an upright position, where it remains by gravity (if leaned forward somewhat to put the center of gravity in front of the pivot axis) or with the help of an upright handle lock mechanism. The vacuum cleaner is also sometimes placed in the upright position during use, such as when the suction motor is connected to an auxiliary cleaning hose.

It is desirable to make sure the handle lock mechanism does not permit unwanted tipping, as such can be inconvenient and may cause damage. In more recent years, it has become increasingly common to position both the suction motor and the dirt collection device in the handle. This places more weight on the handle, and makes it even more important to securely hold the handle in the upright position. Typical handle lock mechanisms use a compact pedal-operated latch on the base, which engages a corresponding hole or shelf on the handle. Examples of such devices are shown in U.S. Pat. Nos. 4,423,534; and 6,006,401, which are incorporated herein by reference. Other handle locks use spring-loaded pins or shafts to retain the handle using an articulated spring-and-catch system that permits rotation after a sufficient force has been applied to press the spring-loaded catch out of engagement. Examples of these devices are shown in U.S. Pat. No. 5,353,471 and U.S. Publication No. 2009/0276975, which are incorporated herein by reference. In devices having a relatively heavy handle, the lock may be fairly robust to bear the weight of the handle, and multi-part spring-and-catch systems can be complicated and expensive to produce.

The base of a typical upright vacuum cleaner comprises a relatively robust structure that holds supporting wheels and the main suction inlet, and carries the entire weight of the handle. Height adjustment mechanisms have been provided to adjust the height of the suction inlet relative to the floor to thereby enhance performance on various different surfaces, ranging from hardwood floors to thick carpets. Height-adjustment devices typically comprises a small wheel assembly, located just behind the suction inlet, that is moved up and down relative to the rest of the base to raise and lower the suction inlet. The wheel assembly typically bears a large portion of the base's weight, and is the first structural part of the device to strike obstacles on the floor, and therefore must be fairly strong and durable.

While various features of upright vacuum cleaners like the ones described above have been used in the art, there still exists a need to provide alternatives to such devices.

SUMMARY

In one exemplary embodiment, there is provided a vacuum cleaner having a base, and an handle assembly. The base has a bottom face, left and right side regions, and an opening between the left and right side regions. A resiliently-deformable crossbeam extends across the opening. The handle assembly is at least partially located in the opening, and pivotally mounted to the base assembly about a first pivot axis extending in the lateral direction. The handle assembly is rotatable, relative to the base assembly, between an upright position and a reclined position. A protrusion extends from and is rotatable with the handle assembly through an arc of travel that at least partially intersects an undeformed position of the crossbeam. The protrusion is positioned on a first side of and in contact with the crossbeam when the handle assembly is in the upright position, and on a second side of and spaced from the crossbeam when the handle assembly is in the reclined position. The protrusion is shaped to deform the crossbeam from the undeformed position to a deformed position when the protrusion is moved between the first side of the crossbeam and the second side of the crossbeam. A suction inlet is on the bottom face of the base assembly, and a suction source is located in one of the base assembly and the handle assembly. A dirt collection device is located in one of the base assembly and the handle assembly, and an air passage system fluidly connects the suction inlet, the suction source and the dirt collection device.

In another exemplary embodiment, there is provided a vacuum cleaner having a carriage, a nozzle, and an handle assembly. The carriage has left and right side regions and an opening between the left and right side regions. A front structure joins the left and right side regions. The carriage also has supports to hold the carriage on a horizontal plane. The nozzle is mounted to the carriage, and has a lower face and a suction inlet through the lower face. The handle assembly includes an upper housing that extends into the opening, a suction source inside the upper housing, and a dirt collection device inside or connectable to the upper housing. A pivot joins the handle assembly to the carriage for rotation about a pivot axis extending in the lateral direction between the left and right side regions. The handle assembly is rotatable, relative to the base assembly, between a first position in which the handle assembly is generally perpendicular to the horizontal plane, and a second position in which the handle assembly is inclined relative to the horizontal plane. An air passage system fluidly connects the suction inlet, the suction source and the dirt collection device. A resiliently-deformable crossbeam is integrally formed with one of the carriage or the upper housing. A protrusion is integrally formed with the other of the carriage or the upper housing. The protrusion is positioned to abut the crossbeam to resiliently hold the handle assembly in the first position until an unlocking force of a predetermined magnitude is applied to cause the protrusion to deform the crossbeam to permit the handle assembly to move from the first position to the second position.

In another exemplary embodiment, there is provided a vacuum cleaner having a base and an handle assembly. The base is configured to traverse a horizontal plane, and has a downward-facing suction inlet and a resiliently-deformable crossbeam. The handle assembly is pivotally mounted to the base adjacent the crossbeam, and rotatable about a pivot axis and movable between a first position in which the handle assembly is generally perpendicular to the base, and a second position in which the handle assembly is inclined relative to the base. A protrusion extends from the handle assembly and is positioned to abut the resiliently-deformable crossbeam to resiliently hold the handle assembly in the upright position. One or more rolling supports are connected to one or both of the base and the handle assembly and positioned to support the base and handle assembly on a horizontal surface. A suction source is located in one of the base assembly and the handle assembly, and a dirt collection device is located in one of the base assembly and the handle assembly. An air passage system fluidly connects the suction inlet, the suction source and the dirt collection device.

The recitation of this summary of the invention is not intended to limit the claims of this or any related or unrelated application. Other aspects, embodiments, modifications to and features of the claimed invention will be apparent to persons of ordinary skill in view of the disclosures herein.

BRIEF DESCRIPTION OF THE DRAWINGS

A better understanding of the exemplary embodiments may be understood by reference to the attached drawings, in which like reference numbers designate like parts. The drawings are exemplary and not intended to limit the claims in any way.

DETAILED DESCRIPTION

The exemplary embodiments described herein relate to upright vacuum cleaners and more specifically to various features of the bases of such vacuum cleaner.

Figure 1:
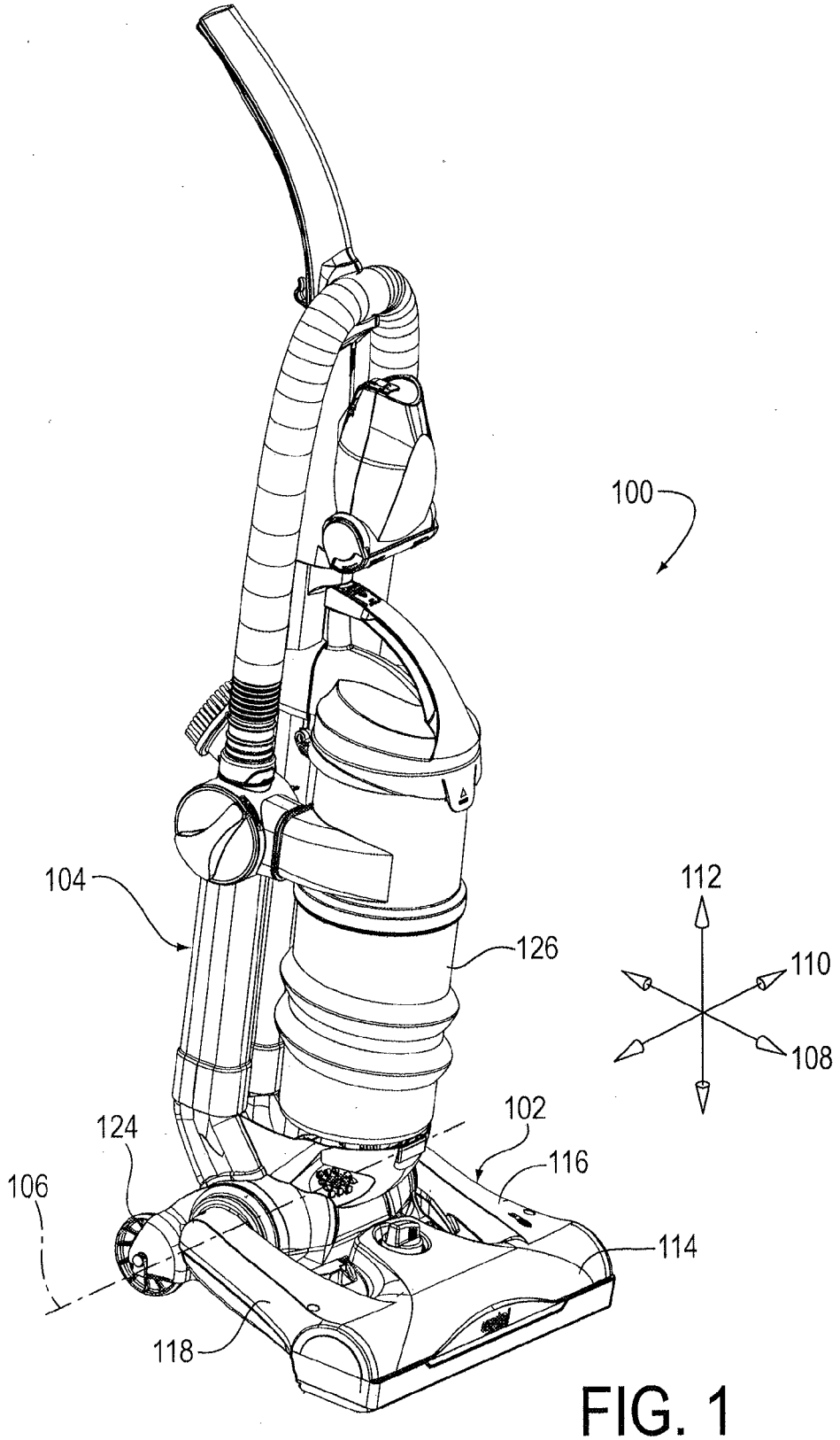
FIG. 1 is an isometric view of an exemplary embodiment of an upright vacuum cleaner incorporating one or more aspects of the present invention.

An exemplary embodiment of an upright vacuum cleaner 100 is shown in FIG. 1. The vacuum cleaner 100 includes a base 102 and a handle 104 pivotally mounted to the base 102 to rotate about a handle pivot axis 106. The base 102 comprises a lower assembly of parts, and the handle 104 comprises an assembly of parts, and together they form a self-contained vacuum cleaning unit. The handle 104 may include a grip, storage for accessory tools, a removable cleaning hose and associated wand, and other typical features of upright vacuum cleaners.

For convenience, the positional relationships of the various parts of the vacuum cleaner 100 are described herein with reference to their orientation when the base 102 is placed on a horizontal surface being cleaned. The fore-aft direction, indicated by arrow 108, lies in the horizontal plane and is the primary movement direction during cleaning. The terms "front," "rear," and the like relate to respective positions in the fore-aft direction 108. The lateral direction, as indicated by arrow 110, is perpendicular to the fore-aft direction 108, but within the horizontal plane. The terms "left," "right," "side," and the like refer to positions in the lateral direction 110. The vertical direction, as indicated by arrow 112, is orthogonal to the horizontal plane and, thus, to both the fore-aft direction 108 and lateral direction 110. The terms "up," "down," "above," "below," and the like refer to positions in the vertical direction 112. It will be appreciated that these terms are used for convenience, and not to delineate strict and exclusive positional relationships. For example, an object that is said to be "above" another part need not be directly above that part in the vertical direction 112, but instead can also be offset in one or both of the other directions. Similarly, a part that extends "vertically" or in the "forward" direction may also extend in another direction.

The base 102 includes an inlet nozzle 114 located in front of the pivot axis 106. The inlet nozzle 114 includes a downward-facing inlet 206 (FIG. 2) to which a suction flow is directed to lift dirt and debris from the surface being cleaned. A brushroll 208 (FIG. 2) or other conventional agitator may be provided in the inlet nozzle 114 to assist with cleaning. The base 102 includes a left side region 116 and a right side region 118 that have an opening between them to receive the bottom of the handle 104. The bottom of the handle 104, in this case, comprises a motor housing in which a suction motor 328 (FIG. 3B) is contained. The base 102 also may have one or more wheels 124 or other supports, such as rolling balls, skid plates and the like.

The suction motor 328, which may alternatively be located in the base 102 or other parts of the handle 104, is connected to the inlet nozzle 114 by a system of one or more air passages. The air passage system also connects to one or more dirt collection devices 126, such as a cyclone separator, filter bag, pleated or panel filter, or the like. The dirt collection devices 126 may be upstream or downstream of the suction motor 328, or both. The dirt collection device may integrated in the vacuum cleaner 100 (as in the case of a non-removable chamber for a filter bag) or connectable to the rest of the vacuum cleaner 100 (as in the case of typical removable cyclone separator units). The details of such dirt collection devices 126 are well-known in the art and not the immediate subject of this application, and thus are not described in detail herein.

Figure 2:
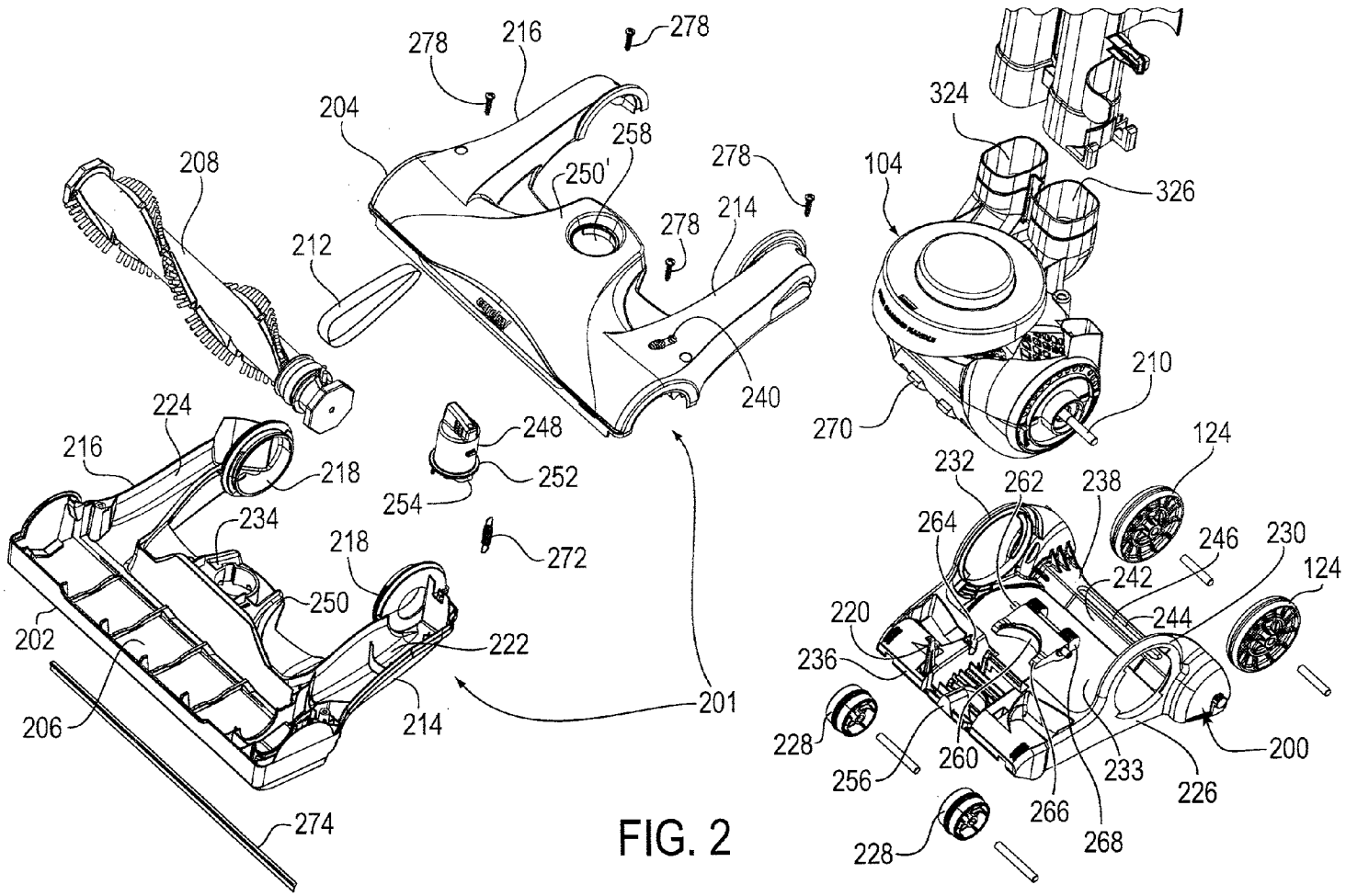
FIG. 2 is an exploded view of the base and a portion of the handle of the vacuum cleaner of FIG. 1.

FIG. 2 is an exploded view of an exemplary base 102 and the lower portion of the handle 104. The base 102 generally includes a carriage 200 and an inlet nozzle assembly 201 that are each pivotally connected to the bottom of the handle 104.

The inlet nozzle assembly 201 comprises a lower nozzle shell 202 and an upper nozzle shell 204 that are joined together to form the inlet nozzle 114. The lower nozzle shell 202 includes the inlet 206 through which air enters the vacuum cleaner. A brushroll 208 is mounted to rotate within the inlet nozzle assembly 201, with the bristles of the brushroll 208 extending through the inlet 206 to contact and agitate the surface being cleaned. The brushroll 208 may be powered by a dedicated motor (not shown), as known in the art, but in a more preferred embodiment, the brushroll 208 is powered by a shaft 210 extending from the suction motor 328, by way of an intermediate belt 212 or gears.

The upper and lower nozzle shells 204, 202 join together to form a left arm 214 in the left side region 116 and a right arm 216 in the right side region 118. The left and right arms 214, 216 extend backwards from the inlet nozzle 114 to connect to the handle 104. The end of each arm 214, 216 includes a nozzle mounting boss 218. The nozzle mounting bosses 218 connect with other parts to form a pivoting connection between the nozzle assembly 201 and the handle 104, such as described below. The nozzle mounting bosses 218 may be formed as part of either or both of the upper and lower nozzle shells 204, 202, or a separate part that is connected to the nozzle assembly 201. The left and right arms 214, 216 may provide a belt tunnel 222 on one side to enclose the drive belt 212, and a base air passage 224 on the other side to fluidly connect the inlet nozzle 114 to a corresponding air passage 324 (see, e.g., FIG. 3) inside the handle 104. In this case, the nozzle mounting bosses 218 may comprise respective openings to pass suction air flow or a belt drive shaft 210.

The exemplary carriage 200 preferably is the primary structure for supporting the weight of the vacuum cleaner 100 on the surface being cleaned. The carriage 200 comprises a frame 226 to which one or more floor-contacting supports are connected. For example, the frame 226 has two rear support wheels 124 located behind the pivot axis 106, and two front support wheels 228 located in front of the pivot axis 106. The wheels 124, 228 may be mounted by respective axles, and may include bushings, bearings or other rotating supports, as desired. It will be appreciated that either of the foregoing pairs of wheels may be replaced by a single wheel, one or more skids, or groups of more than two wheels.

The handle 104 is pivotally mounted to the carriage 200 so that the handle 104 can be moved between an upright storage position and an inclined operating position. The inclined operating position may be a single, discrete orientation relative to the carriage 200, but, more preferably, encompasses a continuous range of orientations to accommodate the natural inclination to continuously raise and lower the handle 104 as the vacuum cleaner is moved back and forth over the floor.

In the shown embodiment, the handle 104 is pivotally mounted to the carriage by a left mounting ring 230 and a right mounting ring 232 that are disposed on opposite sides of the frame 226. The left and right mounting rings 230, 232 have an opening 233 between them to receive the bottom of the handle 104, and are joined by one or more rigid cross-members 236.

Figure 3A:
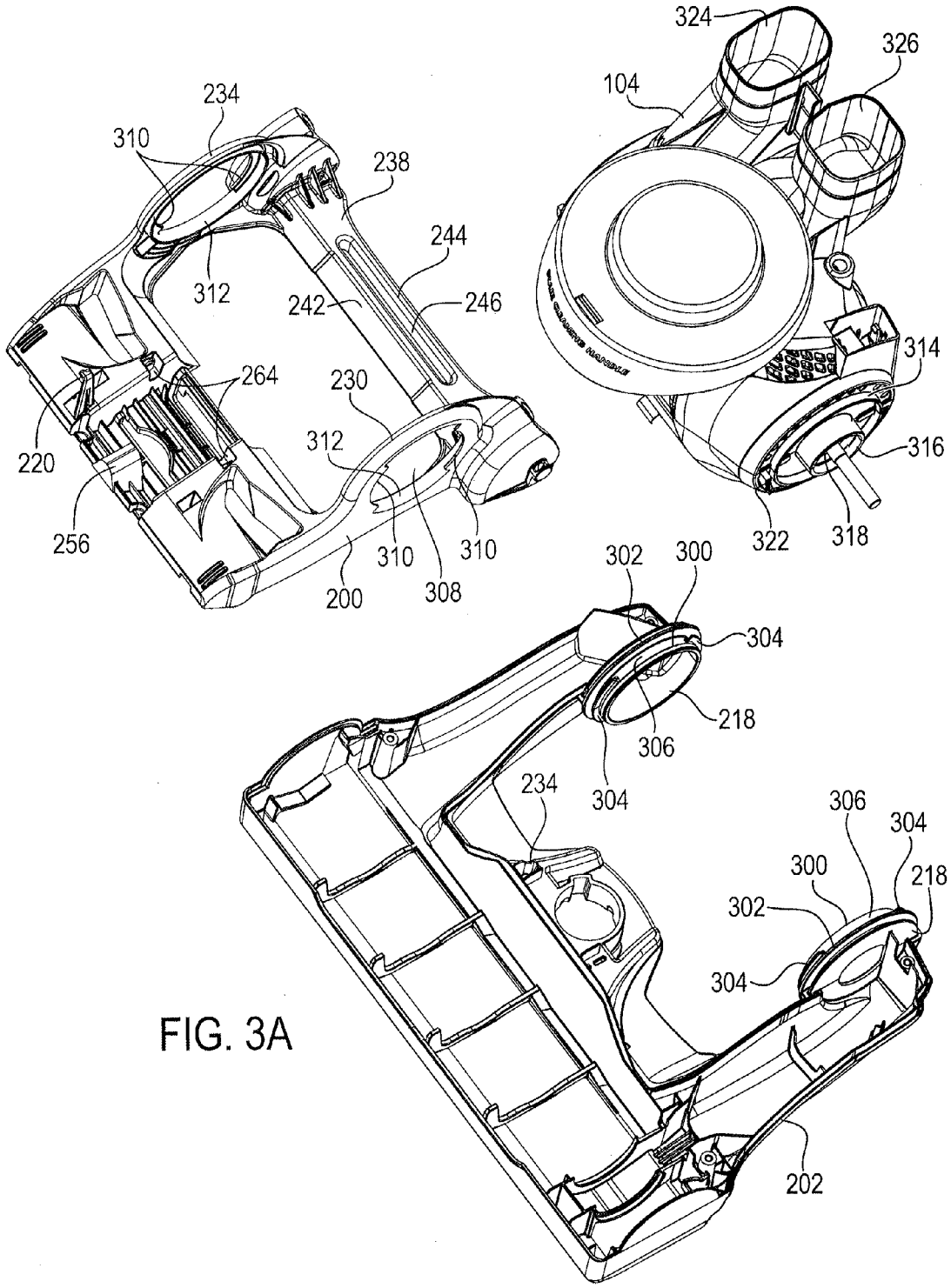
FIG. 3A is an exploded isometric view of parts forming an exemplary embodiment of a mounting arrangement to pivotally connect an upright vacuum cleaner base and handle.
Figure 3B:
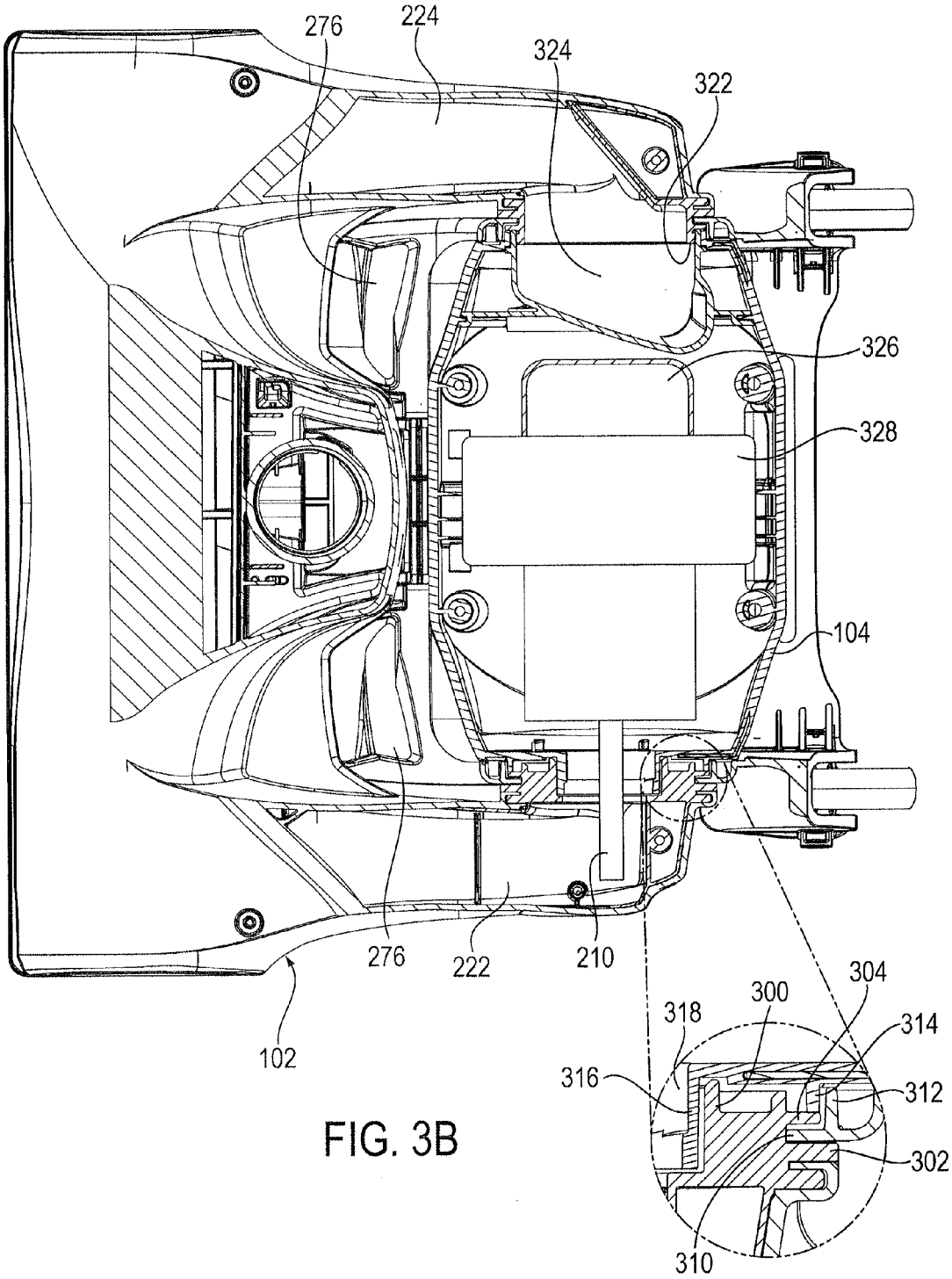
FIG. 3B is a cross-sectional top view of the base and handle of the vacuum cleaner of FIG. 1, shown divided at the pivot that joins the base and handle.

FIGS. 3A and 3B show an exemplary pivotal mounting arrangement to connect the nozzle assembly 201, carriage 200 and handle 104. In this example, the nozzle mounting bosses 218 interlock with the mounting rings 230, 232 to join the nozzle assembly 201 and carriage 200 in a pivoting connection. Any number of interlocking mechanisms may be used for this connection. In this example, each nozzle mounting boss 218 includes a shaft 300 from which a first flange 302 and a second flange 304 extend. The shaft 300 may be hollow to accommodate a belt drive shaft 210 or provide air communication. The first flange 302 may comprise a continuous circular shape, whereas the second flange 304 has one or more gaps 306.

Each mounting ring 230 includes a generally circular opening 308 into which the shaft 300 fits. The opening 308 has inward flanges 310 that are sized to pass through the gaps 306 as the shaft 300 is moved into the opening 308. Once the shaft 300 is fully installed, the nozzle mounting boss 218 is rotated relative to the carriage 200 (e.g., by rotating the entire lower nozzle shell 202) to position the inward flanges between the first and second flanges 302, 304. In this position, the mounting ring 230. 232 are captured in place on the nozzle mounting boss 218 with respect to axial movement along the shaft 300, but free to rotate around the nozzle mounting boss 218 about a rotation axis that is parallel with, and may be collinear with, the handle rotation axis 106.

The mounting rings 230, 232 each include a circular carriage mounting boss 312, which may form the outer perimeter of the opening 308, such as shown, or be spaced from the opening 308. The carriage mounting boss 312 engages a circular handle mounting boss 314 that extends laterally from the side of the handle 104. The carriage mounting boss 312 and handle mounting boss 314 together form a bearing surface to transfer the weight of the handle 104 to the carriage 200. To do so, the carriage mounting boss 312 may either surround (as shown) or be surrounded by the handle mounting boss 314. Low friction coatings, bearings or a bushing material may be used to reduce wear and resistance between these parts, but the use of simply conventional plastic materials is expected to provide a suitable rotating connection. The carriage mounting boss 312 and handle mounting boss 314 define the handle rotation axis 216. In a preferred embodiment, the handle rotation axis is collinear with a rotation axis of the belt drive shaft 210. If desired, one or more travel stops 322 may be provided on the carriage 200 or handle 104 to prevent relative rotation between the carriage 200 and handle 104 beyond a predetermined point. The shown travel stop 322 (which may be provided on both sides of the handle 104) fits into a groove on the inner wall of the mounting ring 230, 232 and the groove is sized to permit a limited range of relative rotation. The outer surface of the mounting ring 230, 232 may be shaped to match the contour of the adjacent portions of the handle 104 to provide a smooth aesthetic appearance.

The nozzle assembly 201, carriage 200 and handle 104 of FIGS. 3A and 3B are assembled in the following manner. First, the carriage 200 is attached to the handle 104 by placing the mounting rings 230, 232 and their respective carriage mounting bosses 312 over the corresponding handle mounting bosses 314. If the carriage 200 is made as a unitary part, it may be necessary to slightly deform the carriage 200 to accomplish this step. This can be avoided by making one or both mounting rings 230, 232 as removable parts, but this will increase the complexity of the device. Next, the lower nozzle shell 202 is positioned with the nozzle mounting bosses 218 on either side of the mounting rings 230, 232, and rotated to orient the gaps 306 in the second flanges 304 with the inward flanges 310 in the mounting ring openings 308. At this point, the lower nozzle shell arms 214, 216 can be pressed towards one another to move the nozzle mounting bosses 218 into place within the mounting rings 230, 232, and the nozzle assembly 201 is rotated to lock the parts together. When fully assembled, the nozzle assembly 201 surrounds both sides of both the carriage 200 and the handle 104 to hold the parts together. In addition, the second flanges 304 and inward flanges 310 preferably are positioned to lock together, as described above, when the nozzle assembly 201 is oriented on the carriage 200 in any normal use position. A hook 220 on the carriage 200 may be provided to engage a corresponding opening 234 on the nozzle assembly 201 to prevent the nozzle assembly 201 and carriage 200 from returning to a position in which they may be unlocked from one another.

It will be appreciated that alternative embodiments may use other arrangements to mount the nozzle assembly 201 and carriage 200 to the handle 104. For example, the parts may be assembled using conventional mounting pins or bearing shafts. As another example, the arrangement of the parts may be reversed, with the mounting rings 230, 232 located outward of the nozzle assembly mounting bosses 218. Other variations and modifications will be apparent to persons of ordinary skill in the art in view of the present disclosure.

On the left side of the exemplary embodiment, the belt drive shaft 210 extends into the belt tunnel 222. The belt tunnel 222 may be openable to service the belt 212. For example, the lower and upper nozzle shells 202, 204 may be connected by readily-accessed service screws 278 that can be removed to access the belt 212, or a separate removable panel may be provided on or between the shells 202, 204. The nozzle mounting boss shaft 300 may include an inner boss 316 that closely surrounds a tunnel 318 through which the belt drive shaft 210 passes, to help prevent the egress of motor debris (e.g., carbon dust).

On the right side, the base air passage 224 turns inwards and fluidly connects to a first handle passage 324 located inside the handle 104. The nozzle mounting boss shaft 300 on this side may have a relatively close tolerance to the inside of the handle mounting boss 314 to help prevent air leaks at this joint. Such tolerance may be provided simply by sizing the entire shaft to fit closely within the handle mounting boss 314, or by adding an outward flange 322 that extends towards the handle mounting boss 314, such as shown in FIG. 3B. If desired, one or more seals, such as felt pads or rubber skirts, may be added to the joint to further reduce air leaks. The first handle passage 324 turns upwards to lead to a dirt collection device 126. A second handle passage 326 is provided to connect the outlet of the dirt collection device 126 to the inlet of the suction motor 328. This so-called "clean air" system removes the majority of the dirt from the air before the air enters the suction motor 328, and the air leaving the suction motor 328 is vented to the atmosphere either directly or through a post-motor filter. In an alternative embodiment, the system may be a "dirty air" system in which the first handle passage 324 leads directly to the suction motor 328, and the second handle passage 326 leads from the outlet of the suction motor 328 to the inlet of the dirt collection device 126.

It is often desirable to store an upright vacuum cleaner handle in the upright position, such as when the cleaner is not in use or when it is being used with an accessory cleaning hose. To this end, the vacuum cleaner 100 may include a storage lock that prevents the handle 104 from pivoting backwards relative to the base 102 when it is unattended. Conventional storage locks typically comprise a foot-operated hook on the base, and a corresponding slot on the handle into which the hook fits to prevent handle rotation. Such devices require a separate foot-pedal to actuate the hook and a spring to bias the hook into the engaged position. This assembly can add unwanted cost to the device, must be robustly made to withstand the full weight of the operator (and thus heavy), and is subject to breakage. It also can be difficult to assemble the parts, as the spring often must be compressed during assembly. Furthermore, the area of the base 102 to which the foot-pedal is connected also may need to be reinforced to hold the pedal and resist the spring force, and support the user's weight when the pedal is activated. Another problem with conventional foot-pedals is that they are often mistaken for a power button (and vice-versa), particularly by operators who are unfamiliar with the device or unable to see the markings on the pedals, which leads to annoyance and dissatisfaction with the product. Other storage locks comprises a spring-loaded catch that may be released by overcoming the spring force. Such devices use a movable sliding or pivoting catch, along with a separate spring that biases the catch into place. The small surface area of the catch can require relatively strong local reinforcements to the vacuum cleaner structure to resist point loads, and the separate spring adds cost and complexity. Spring-loaded storage locks also may not be suitable for relatively heavy cleaners, because the weight of the cleaner may accidentally act to release the lock. While the storage locks described above may be used in some embodiments, a more preferred embodiment does away with a separate storage lock assembly and instead uses an integral storage lock system.

An example of an integral storage lock system is illustrated in the exploded view of FIG. 2 and the cross-sectional side views of 4A-4C. The exemplary storage lock assembly includes a resiliently-deformable crossbeam 238 and a protrusion 400. The crossbeam 238 preferably is located on the carriage 200, but may be elsewhere on the base 102, such as on the nozzle assembly 201. In the shown embodiment, the crossbeam 238 extends across the opening 233, and is connected at each end to one side of the frame 226. The crossbeam 238 preferably is located behind the handle pivot axis 106, but may be below or in front of the handle pivot axis 106 in other embodiments.

Figure 4A:
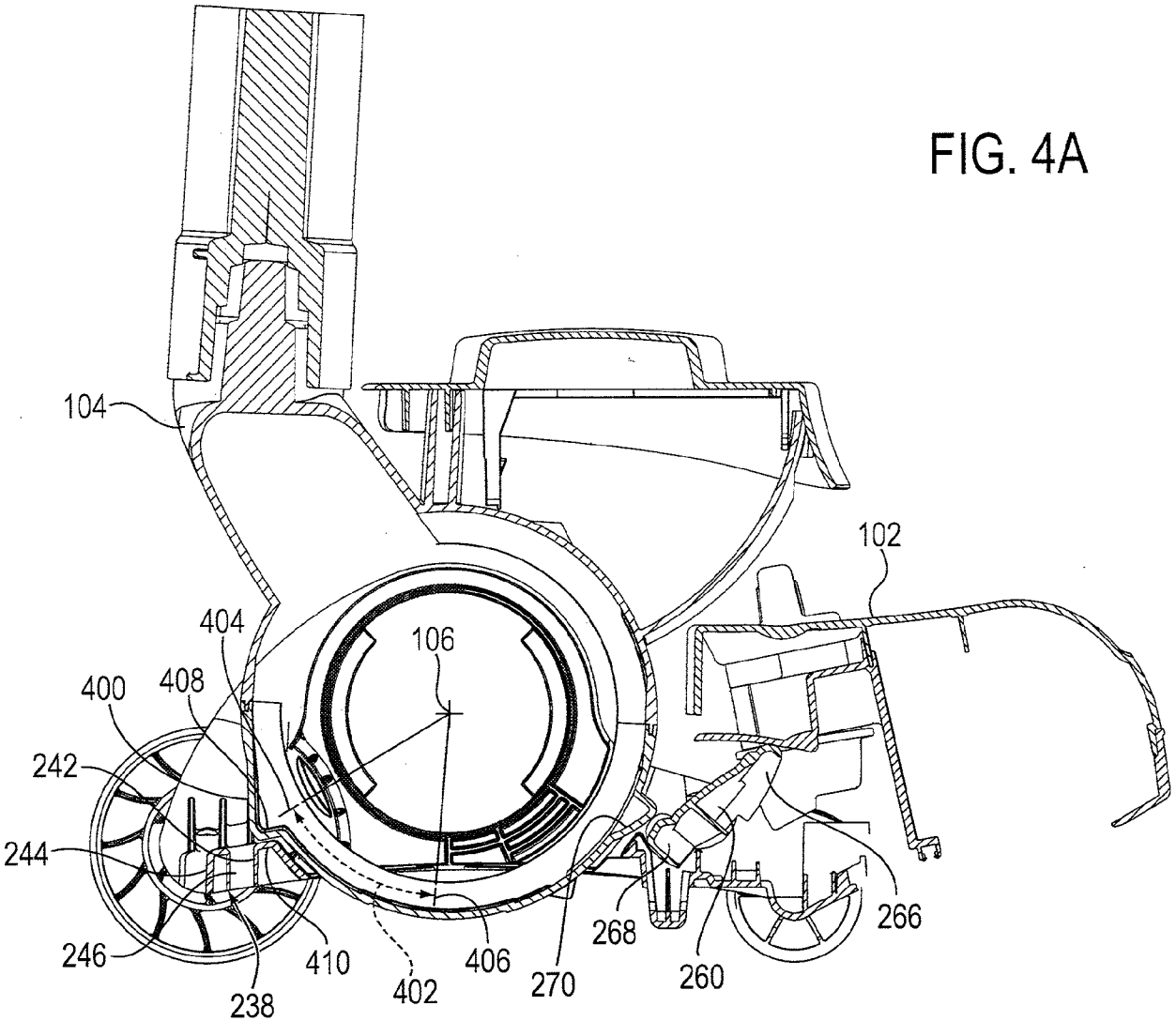
FIGS. 4A-4C are cross-sectional side views of the vacuum cleaner of FIG. 1, as seen at the longitudinal centerline of the device, showing the handle in three different positions relative to the base.

The protrusion 400 comprises an extension of the handle 104, and may be a separate attached part or molded integrally with the handle's housing. In the shown embodiment, the protrusion 400 is a wedge-shaped radial extension of the housing, but other shapes may be used. The protrusion 400 rotates with the handle 104, and moves through an arc of travel 402. The arc of travel 402 is centered on the handle pivot axis 106, and extends between an upright end 404 (where the protrusion 400 is located when the handle 104 is in the upright position with respect to the base 102), and a reclined end 406 (where the protrusion 400 is located when the handle 104 is at its lowest inclination with respect to the base 102). The arc of travel 402 may comprise any suitable range of movement, such as a range of approximately 20 to 120 degrees, as measured around the handle pivot axis 106. The crossbeam 238 is positioned to intersect the arc of travel 402 near the upright end 404, to thereby contact and hold the protrusion 400 with the handle 104 in the upright position, such as shown in FIG. 4A. In this position, shown in FIG. 4A, a first side 408 of the protrusion 400 contacts a first side 410 of the crossbeam 238.

Figure 4B:
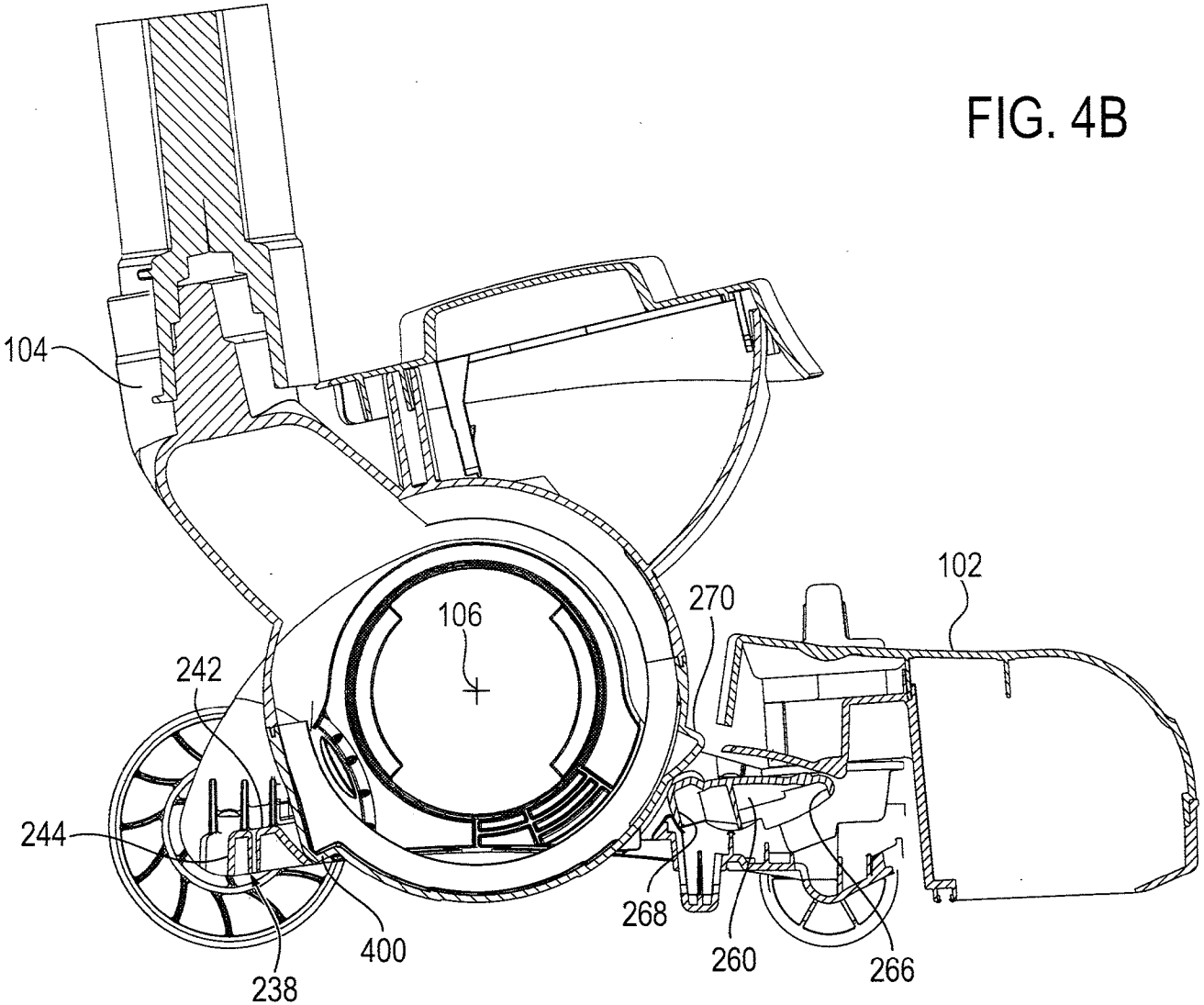

The handle 104 is reclined from the storage position by applying an unlocking force to move the protrusion 400 past the crossbeam 238. During this movement, the protrusion 400 presses against and temporarily deforms the crossbeam 238, such as shown in FIG. 4B. The unlocking force is generated by applying opposite rotation forces to the handle 104 and the base 102. These forces may be generated in a variety of ways, but it is expected that the unlocking force will typically be generated by pulling back on the handle 104 with a hand, while simultaneously pressing downward with a foot on the front of the base 102. A graphic instruction image 240, such as a representation of a foot or shoe, may be provided on the top of the base 102 to guide the operator on how or where to generate the necessary unlocking force. This instruction image 240 may be located at a region of the base 102 that is particularly suited—such as in relation to the strength or shape of the region—to manage the directed force.

Figure 4C:
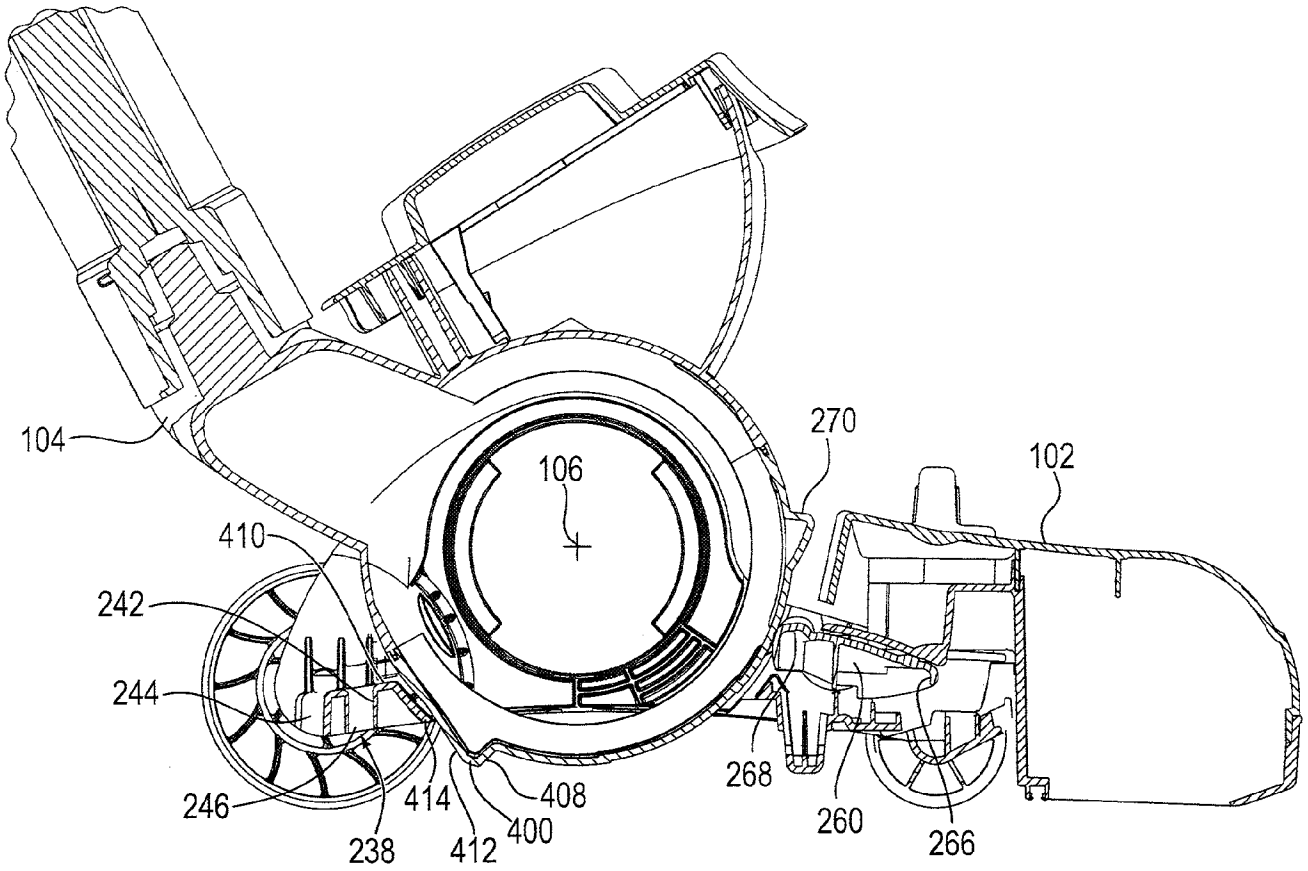

Once the protrusion 400 clears the crossbeam 238, such as shown in FIG. 4C, the handle 104 is freely pivotable with respect to the base 102 throughout the remainder of the protrusion's arc of travel 402. The freely-rotatable range that makes up the reclined position may comprise a range of approximately 30 to 100 degrees from the reclined position towards the upright position without contact between the protrusion 400 and the crossbeam 238, but other ranges may be used in other embodiments.

The handle 104 is returned to the upright position by moving the handle 104 forward until a second side 412 of the protrusion 400 contacts a second side 414 of the crossbeam 238, and then applying a locking force to cause the protrusion 400 to deform the crossbeam 238. The locking force is generated by applying opposite rotation forces to the handle 104 and the base 102, but in this case it may only be necessary to push forward on the handle 104 with a hand, as the necessary force on the base 102 can be applied by contact with the floor. If the required locking force is great enough, it may be necessary to tip the vacuum cleaner 100 forward onto the front of the base 102, and perhaps even to push down on the handle 104 with the vacuum cleaner leaned forward, to generate the necessary force.

The unlocking and locking forces can be selected and adjusted by modifying the shapes and elastic moduli of the protrusion 400 and crossbeam 238. For example, forming the one or both of the contacting sides of the protrusion 400 and crossbeam 238 as a gradual slope can reduce the apparent required locking or unlocking force, but may allow some relative movement even when the parts are locked together. Forming one of both of the contacting sides as a steep ramp would increase the apparent locking or unlocking force, but potentially provide a more distinct lock with less slack. In the shown exemplary embodiment, the first side of the protrusion 400 and the first side 410 of the crossbeam 238 abut one another on a plane that has a relatively large angle relative to the arc of travel 402, as shown in FIG. 4A, whereas the second side 412 of the protrusion 400 abuts the second side 414 of the crossbeam 238 at an angle that is relatively small relative to the arc of travel 402, as shown in FIG. 4C. It will be apparent, from these figures that a force applied along the arc of travel 402 to move the handle 104 from the upright position will generate a relatively low vector force to deform the crossbeam 238, whereas a force applied along the arc of travel 402 to move the handle from the reclined position back up to the upright position will generate a much larger vector force to deform the crossbeam 238. Stated differently, the parts are shaped to require a larger unlocking force than the locking force.

The length and cross-sectional shape of the crossbeam 238 also affect its rigidity and thus the amount of force necessary to unlock and lock the handle 104. In the shown embodiment, the crossbeam 238 extends laterally across the of the opening 233, and may provide structural support to hold the rear wheels 124 in proper alignment. To provide the necessary stiffness as a structural element, while still being resilient enough to act as a deformable lock, the crossbeam 238 may be formed as a flexible spar 242 and a relatively rigid spar 244 that are assembled together or integrally formed as a single structure that spans the opening 233. In this case, the crossbeam 238 is a molded plastic part (which preferably is integrally molded with the frame 226, but may be a separate part), and the flexible spar 242 and rigid spar 244 are formed by dividing the crossbeam 238 with a laterally-elongated slot 246. The slot 246 may be an open slot that passes all the way through the crossbeam 238 (as shown), a closed slot that does not pass all the way through the crossbeam 238, or a combination of slot structures. Multiple slots 246 also may be provided to further modify the stiffness of the crossbeam 238. In the shown embodiment, the single open slot 246 reduces the stiffness of the crossbeam 238, so that the flexible spar 242 flexes into the space within the slot 246 to permit the protrusion 400 to move between the storage and upright positions, and the rigid spar 244 does not flex any appreciable amount during locking and unlocking. An example of this arrangement is illustrated in FIG. 4B. The length of the slot 246 and flexible spar 242 may be modified to adjust the stiffness of the flexible spar 242. In the present embodiment, the slot 246 and flexible spar 242 extend only a portion of the distance across the opening 233. If greater or lesser locking forces are desired, the slot 246 may be shortened or elongated, respectively. Changing the thickness or cross-sectional shape of the flexible and rigid spars 242, 244 also will affect the stiffness, as will be appreciated upon review of the present specification.

The location and size of the protrusion 400 also can affect the locking and unlocking forces. In the shown embodiment, the protrusion 400 is located midway between the ends of the crossbeam 238, and halfway across the opening 233, on the centerline of the handle 104. This places the protrusion 400 at the most flexible part of the crossbeam 238. In other embodiments, other locations may be used. The protrusion 400 may be relatively large, to distribute the loading force to reduce point loads that could cause fatigue or excessive wear. For example, the protrusion may be at least about 1 inch wide or wider, to distribute the load to a correspondingly-sized portion of the crossbeam 238. In addition, the protrusion 400 itself may be made with some resilience such that it also deforms to permit locking and unlocking.

Figure 7:
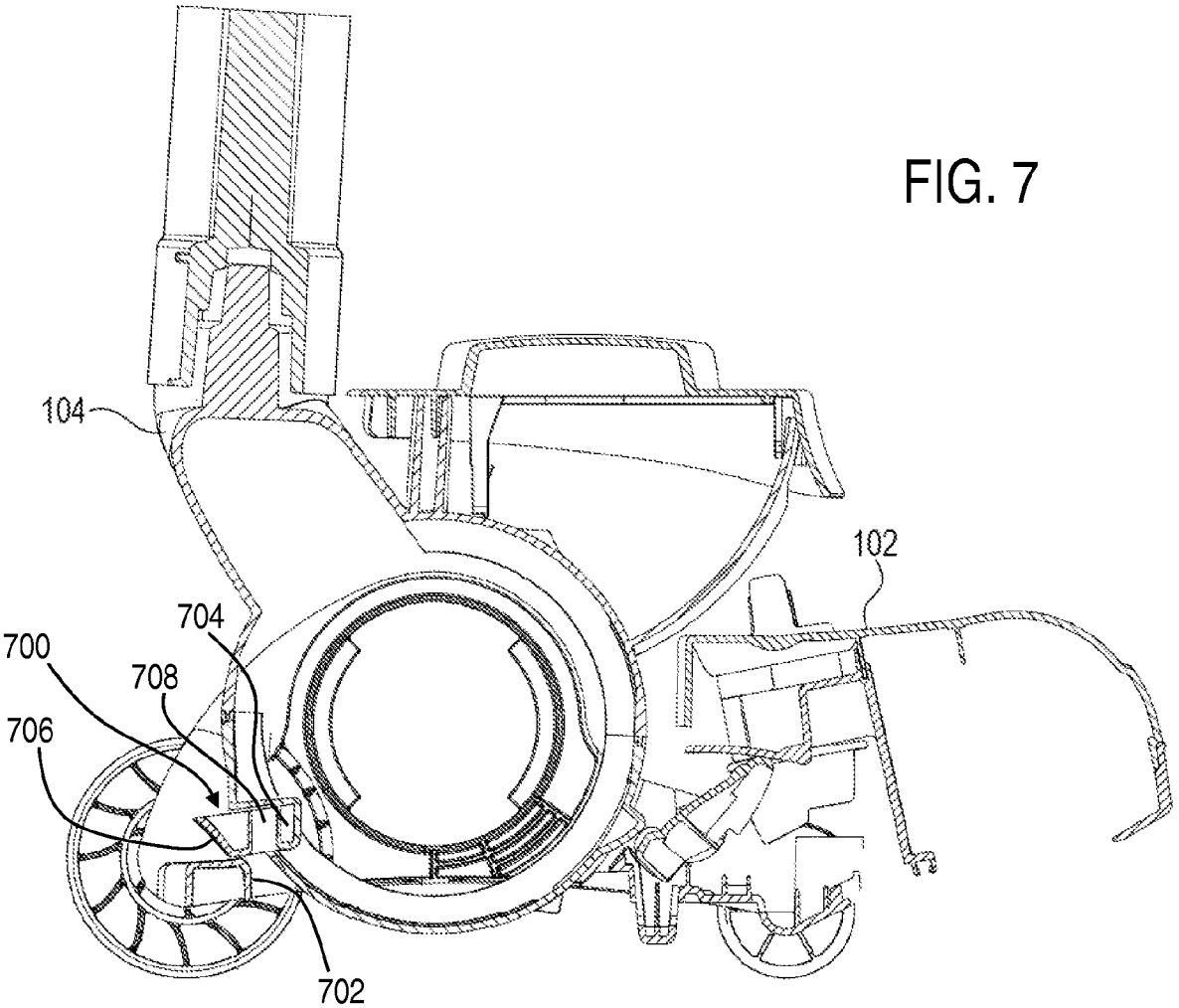
FIG. 7 is a schematic cross-sectional side view of an alternative embodiment of a vacuum cleaner.

While these arrangements are preferred, it will be appreciated that variations may be made while providing essentially the same function and results. For example, the crossbeam 238 and protrusion 400 may be interposed in other embodiments, such as shown in FIG. 7, with the protrusion 702 being on the base 102, and the crossbeam 700 (which includes the rigid spar 704, flexible spar 706 and cavity 708) being on the handle 104. As another example, the crossbeam 238 may be a cantilevered beam that extends part-way across the opening 233.

The exemplary embodiment and variations thereof are expected to provide benefits over conventional handle lock arrangements. The crossbeam 238 and protrusion 400 are readily formed as parts of conventional plastic molds, and require no moving parts or added springs, and therefore may not add any substantial costs (or any costs at all) to the product. The use of a flexible crossbeam 238 also eliminates the need to have a release pedal and its associated hardware and mounting supports, which may significantly reduce weight. In addition, the locking and unlocking forces may be borne by the relatively large areas of the crossbeam 238 and protrusion 400, as opposed to the small hooks and slots used in conventional devices, which distributes the locking and unlocking forces across a large area and allows the parts to be made from relatively light and thin-walled materials that do not need to resist the point loads generated by conventional locks. The use of a crossbeam 238 that completely spans the distance between the handle pivot locations also allows a relatively large deflection distance without generating local stresses that could fatigue or wear away the parts. Also, the use of a slot 246 to form a flexible spar 242 and a rigid spar 244 and allows the crossbeam 238 to act both as a rigid structural frame element and as a deformable lock mechanism, which opens up the possibility of locating the locking mechanism behind the pivot axis 106 without having to add any significant extra bulk to the device. Other features and benefits will be apparent from the present disclosure and practice of the invention.

Referring back to FIG. 2, the base also may include a height-adjusting mechanism that raises and lowers the downward-facing inlet 206 relative to the surface being cleaned. In the shown embodiment, the height-adjusting mechanism comprises a knob 248 that is rotatably mounted to a boss 250 that extends from the lower nozzle shell 202. The knob 248 has a bearing surface 252 that abuts a bottom side of the boss 250 and holds the boss 250 in the vertical direction. Below the bearing surface 252 is a circular cam 254, which may be a smooth circular ramp or have a series of discrete steps located at different distances from the bearing surface 252. When the inlet nozzle assembly 201 and carriage 200 are mounted to the handle 104, the circular cam 254 abuts a post 256 on the carriage 200. Rotating the knob 248 slides the circular cam 254 along the post 256, which causes the circular cam 254 to act as a wedge to raise or lower the inlet nozzle assembly 201 relative to the carriage 200. The general principal of operation of such a device is illustrated, for example, in U.S. Pat. No. 7,246,407, which is incorporated herein by reference.

The knob 248 may be accessed directly, or through a corresponding access hole 258 through a corresponding boss 250' formed on the upper nozzle shell 204. When the inlet nozzle assembly 201 is assembled, the bosses 250, 250' form a single structure that extends backwards from the inlet nozzle 114, and the top of the knob 248 is accessed from above the inlet nozzle assembly 201, as shown in FIG. 1. Height setting indicators (not shown) may be provided on the upper nozzle shell 204 surrounding the access hole 258 to indicate the selected height setting.

It will be appreciated that changes may be made to the foregoing height adjustment mechanism, and variations and modifications will be apparent to persons of ordinary skill in the art in view of the present disclosure. It will also be appreciated that other kinds of height adjusting mechanism may be used on other embodiments. For example, the knob and its circular cam may be replaced by a sliding linear cam, such as shown in U.S. Patent Publication No. 2006/0070209, or a rotating wheel, such as shown in U.S. Pat. No. 7,895,707.

Embodiments also may include features to disengage the brushroll 208 when the handle 104 is moved to the upright position. This may be desirable to prevent the brushroll 208 from continuing to rotate in one place on a carpet or other floor surface when the handle 104 is upright, but the vacuum cleaner 100 remains on (e.g., during above-floor cleaning with an accessory hose). Where the brushroll 208 has a dedicated drive motor, a microswitch or other device may be provided to turn off the dedicated motor upon placing the handle 104 into the upright position. Such microswitches and brushroll shut-off circuits are known in the art and need not be described here. In embodiments in which the brushroll 208 is driven by the suction motor 328, such as in the shown example, power from the suction motor 328 to the brushroll 208 can be terminated by disengaging the drive belt 212 by any of a variety of mechanisms. Known devices include, for example, belt tensioner pulleys that are slacked to release belt tension, idler pulleys onto which the belt 212 is slid, and belt lifters that lift the belt 212 out of engagement with the drive shaft 210. Such devices are conventional and need not be described here. Alternatively, the brushroll 208 can continue to be powered, but simply lifted out of contact with the underlying floor by a nozzle-lifting mechanism.

The illustrated exemplary embodiment includes a nozzle-lifting mechanism in the form of a liftoff lever 260. The liftoff lever 260 is mounted on the carriage 200 by two pivot bosses 262 on the liftoff lever 260 that fit into corresponding pivot grooves 264 on the carriage 200. When so mounted, the liftoff lever 260 is free to rock between a first position in which a front end 266 of the liftoff lever 260 is lowered and a back end 268 of the liftoff lever 260 is raised, and a second position in which the front end 266 of the liftoff lever 260 is raised and the back end 268 of the liftoff lever 260 is lowered.

The front end 266 is located under the inlet nozzle assembly 201. For example, the shown liftoff lever's front end 266 may be shaped to fit immediately behind the height adjustment knob's bearing surface 252. When the liftoff lever 260 is in the first position, the front end 266 is lowered and clear of the inlet nozzle assembly 201, which permits the inlet nozzle assembly 201 to lower and raise freely as the operator adjusts the height adjustment knob 248. When the liftoff lever 260 is placed in the second position, the front end 266 presses upwards on the bottom of the inlet nozzle assembly 201 and lifts it high enough for the brushroll 208 to clear the underlying floor. In this latter position, the inlet nozzle assembly 201 may be above the highest setting provided by the height adjustment knob 248. In other embodiments, the liftoff lever 260 may be used even if a height adjustment mechanism is not provided.

The liftoff lever 260 may be operated by a separate control such as a foot pedal, but more preferably is operated by the handle 104 as the handle 104 is moved into the upright position. For example, the handle 104 may include one or more protrusions 270 that rotate with the handle 104. As the handle 104 is rotated to the upright position, the protrusions 270 eventually contact the back end 268 of the liftoff lever 260 to move the liftoff lever 260 into the second position to raise the inlet nozzle assembly 201. Other engaging mechanisms, such as slots in the handle 104 and corresponding ribs or lobes extending from the liftoff lever 260, may be used in other embodiments.

The operation of the exemplary liftoff lever 260 is illustrated in the cross-section views of FIGS. 4A-4C. FIG. 4A shows the liftoff lever 260 in the second position, as it is positioned when the handle 104 is upright. FIGS. 4B and 4C show the liftoff lever 260 transitioning to and entering the first position as the handle 104 is leaned backwards. Motion of the liftoff lever 260 is caused by contact between the protrusions 270 and the back end 268 of the liftoff lever 260.

The foregoing exemplary embodiment and variations thereof are expected to provide a simple, inexpensive, and lightweight liftoff mechanism having a single moving part interposed between the handle 104 and the base 102. However, other activation mechanisms may be used in other embodiments. For example, the liftoff mechanism may be connected to and driven by a linkage that is drivingly connected to the handle 104, or it may be a manually-operated mechanism that is operated by a foot pedal or a similar manual control.

Various other features may be provided in the base 102. For example, a spring 272 may be provided to pull the inlet nozzle assembly 201 towards the carriage 200, to prevent the inlet nozzle assembly 201 from freely lifting above the height established by the height adjustment knob 248. The inlet nozzle assembly 201 also may include a belt cover (not shown) that encloses the belt 212 and closes off the left arm 214 to inhibit dirt and air entering the inlet 206 from fouling the belt 212. Also, a flexible wiper 274, bristles, or other cleaning members may be connected to the base 102 to contact the floor to assist with cleaning. Other variations and modifications will be apparent to persons of ordinary skill in the art in view of the present disclosure.

Figure 5:
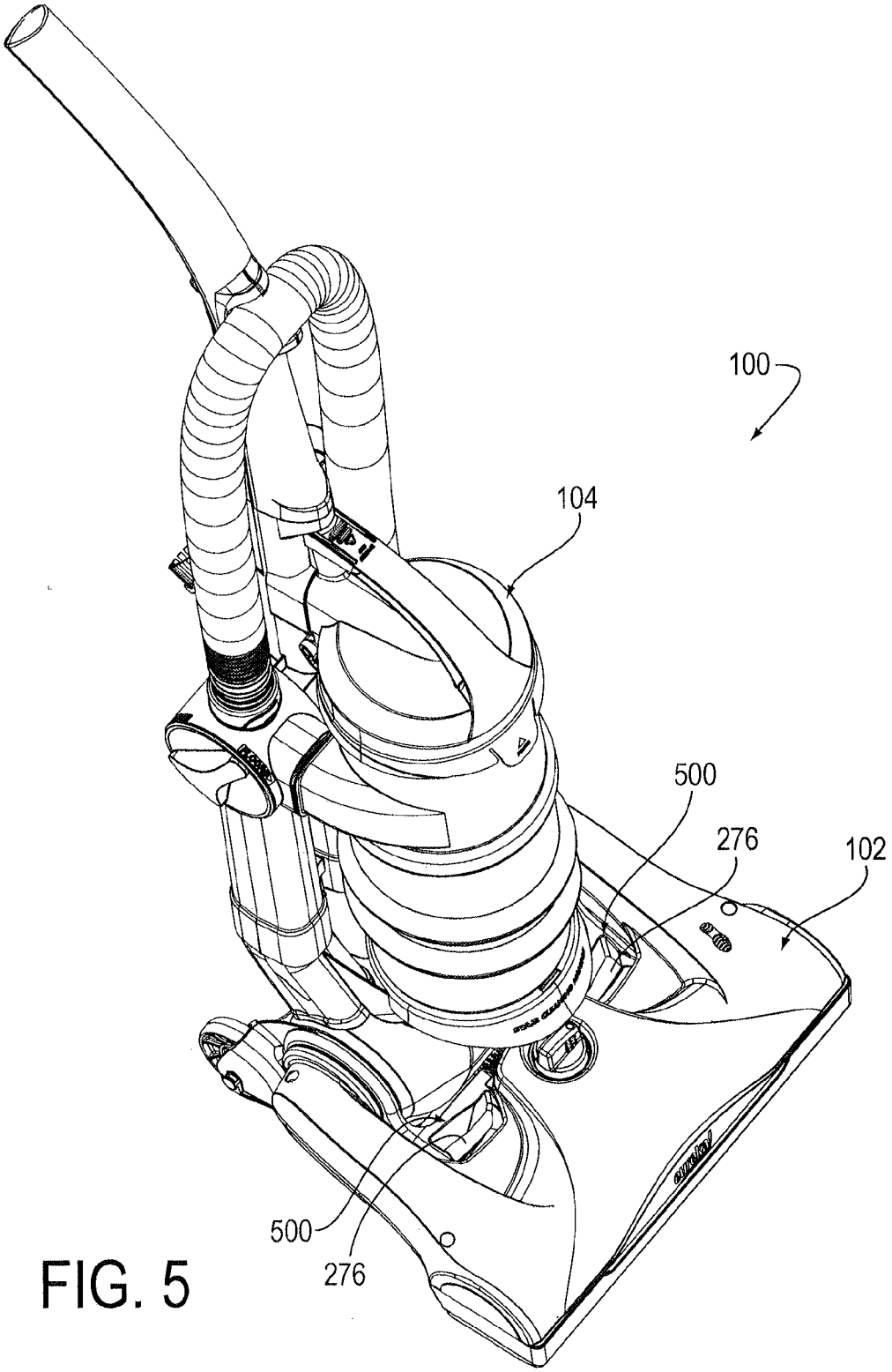
FIG. 5 is a detailed top isometric view of the base and lower portion of the handle of the vacuum cleaner of FIG. 1.
Figure 6:
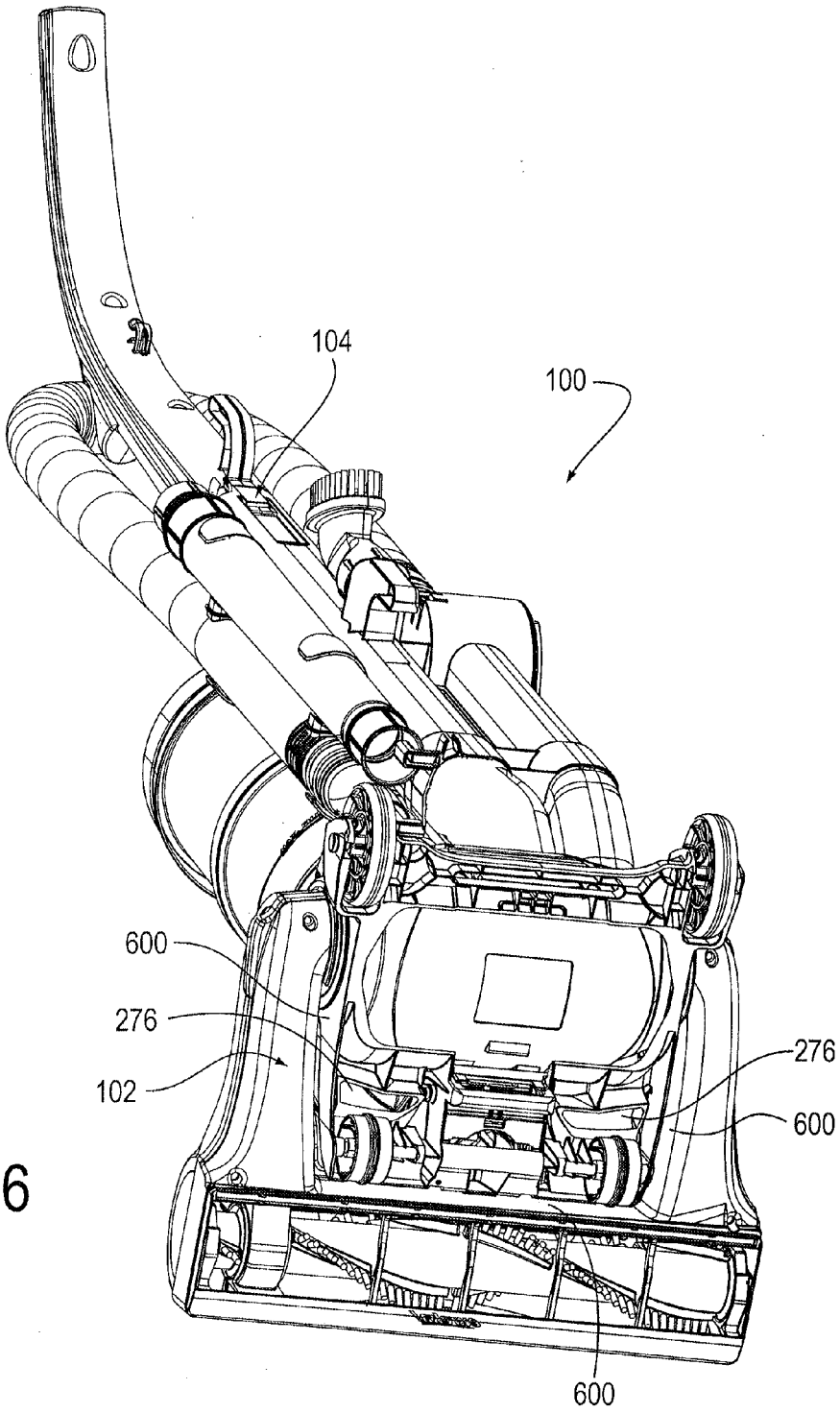
FIG. 6 is a detailed bottom isometric view of the base and lower portion of the handle of the vacuum cleaner of FIG. 1.

As shown in FIGS. 5 and 6, the arrangement of the exemplary inlet nozzle assembly 201 and carriage 200 provides a unique and beneficial arrangement. As described above, the inlet nozzle assembly 201 and carriage are separately pivotally mounted to the handle 104. This allows the carriage 200 to hold the weight of the support wheels 124, 228, and the majority of the handle's weight is transmitted through the carriage 200 and to the floor via the left and right mounting rings 230, 232 and support wheels 124, 228. Thus, only the left and right mounting rings 230, 232 need to be designed as load-bearing members. By shifting the weight of the wheels 124, 228 and the weight-bearing duties to the carriage 200, the inlet nozzle assembly 201 can be made as a relatively lightweight structure with light-duty pivots to join it to the handle 104, and the height-adjusting mechanism does not need to bear as large a weight. This arrangement also facilitates the production of a variety of different products by simply replacing the nozzle assembly. For example, a range of vacuum cleaners can be produced having: different widths or types of floor agitator (or with no brushroll or other agitator); different (or no) height-adjustment mechanisms, different brushroll drive systems (e.g., the addition of a dedicated brushroll motor); and so on. Such modifications can be made at relatively little cost simply by replacing the inlet nozzle assembly 201, and the carriage 200 and handle 104 need not be redesigned or separately made for each individual product in the product line.

The separated inlet nozzle assembly 201 and carriage 200 arrangement also may allow a simpler inlet nozzle assembly construction that does away with complex molded parts having numerous cavities as found in conventional devices. As shown in FIG. 2, the lower nozzle shell 202 comprises a simple structure having a single continuous C-shaped channel, and the upper nozzle shell 204 is correspondingly-shaped. The assembled inlet nozzle assembly 201 may comprise only an inlet nozzle 114, left and right arms 214, 216 that extend backwards from the inlet nozzle 114 to the handle 104, and a height-adjustment mechanism boss 250, 250' that extends backwards from the inlet nozzle 114.

The remaining space between the inlet nozzle 114 and the handle 104 may be open, which can provide additional benefits. For example, providing an opening or openings through the inlet nozzle assembly 201 may permit the operator to view the carriage 200 to confirm its position relative to the inlet nozzle assembly 201 or view the floor below the carriage 200. In this case, there are two openings 500 (FIG. 5), with one being located on each side of the boss 250, 250', but other numbers of openings may be provided. For example, the boss 250, 250' may be moved to one side or removed to provide a single large opening.

The carriage 200 may have one or more openings 276 located below the open portions 500 of the inlet nozzle assembly 201. Further openings also may be provided by gaps 600 (FIG. 6) between the back of the inlet nozzle 114 and the inner edges of the left and right arms 214, 216 and the front and sides of the carriage 200. These openings 276 and gaps 600 act as vents to allow ambient air to enter the space below the inlet nozzle assembly 201 and carriage 200 and immediately behind the downwardly-facing inlet 206. This airflow may be useful to prevent the accumulation of a large low-pressure region under the center of the base 102 (which can lift loose carpets and the like at a location behind the inlet 206), and to allow air to pass more readily into the back edge of the inlet 206, which may enhance cleaning performance under some circumstances. The openings 276 also beneficially allow an operator to observe the condition of the underlying floor.

The present disclosure describes a number of new, useful and nonobvious features and/or combinations of features that may be used alone or together. The embodiments described herein are all exemplary, and are not intended to limit the scope of the inventions. It will be appreciated that the inventions described herein can be modified and adapted in various and equivalent ways, and all such modifications and adaptations are intended to be included in the scope of this disclosure and the appended claims.

We claim:

1. A vacuum cleaner comprising:

a base assembly having a bottom face, a left side region, a right side region spaced apart in a lateral direction from the left side region, an opening between the left side region and the right side region, and a resiliently-deformable crossbeam extending across the opening and joining the left side region to the right side region, the crossbeam having a left end integrally formed as a unitary part with the left side region, a right end integrally formed as a unitary part with the right side region, and a fixed middle portion extending from the left end to the right end;

a handle assembly at least partially located in the opening and pivotally mounted to the base assembly about a first pivot axis extending in the lateral direction, the handle assembly being rotatable, relative to the base assembly, between an upright position and a reclined position;

a protrusion extending from the handle assembly and rotatable therewith through an arc of travel that at least partially intersects the middle portion of the crossbeam when the crossbeam is in an undeformed position, the protrusion being positioned on a first side of and in contact with the middle portion of the crossbeam when the handle assembly is in the upright position, and on a second side of and spaced from the middle portion of the crossbeam when the handle assembly is in the reclined position, and wherein the protrusion is shaped to deform the middle portion of the crossbeam linearly away from the opening from the undeformed position to a deformed position when the protrusion is moved between the first side of the crossbeam and the second side of the crossbeam;

a suction inlet on the bottom face of the base assembly;

a suction source located in one of the base assembly and the handle assembly;

a dirt collection device located in one of the base assembly and the handle assembly; and an air passage system fluidly connecting the suction inlet, the suction source and the dirt collection device.

2. The vacuum cleaner of claim 1, wherein the base assembly comprises a carriage and a nozzle pivotally mounted to the carriage about a second pivot axis.

3. The vacuum cleaner of claim 2, wherein the carriage comprises a plurality of wheels configured to support the vacuum cleaner on a horizontal plane.

4. The vacuum cleaner of claim 2, wherein the first pivot axis is collinear with the second pivot axis.

5. The vacuum cleaner of claim 2, wherein the bottom face and suction inlet are on the nozzle and the left side region and the right side region are on the carriage.

6. The vacuum cleaner of claim 1, wherein the suction inlet is located in front of the handle assembly, and the crossbeam is located behind the handle assembly.

7. The vacuum cleaner of claim 1, wherein the crossbeam comprises a rigid spar and a flexible spar.

8. The vacuum cleaner of claim 7, wherein the rigid spar extends from the left side region to the right side region, and the flexible spar extends a portion of the distance from the left side region to the right side region.

9. The vacuum cleaner of claim 1, wherein the protrusion is located between the left side region and the right side region and crosses a lateral centerline of the vacuum cleaner.

10. The vacuum cleaner of claim 1, wherein the handle assembly comprises a housing and the protrusion comprises a wedge-shaped radial extension of the housing.

11. The vacuum cleaner of claim 1, wherein the handle assembly is rotatable, relative to the base assembly, through a total of at least approximately 30 degrees, as measured around the first pivot axis, and is freely rotatable through at least approximately 20 degrees from the reclined position towards the upright position without contact between the protrusion and the crossbeam.

12. The vacuum cleaner of claim 1, further comprising an indicator on the base assembly identifying a region of the base assembly configured to receive a downward force to assist with moving the protrusion from the first side of the crossbeam to the second side of the crossbeam.

13. The vacuum cleaner of claim 12, wherein the indicator comprises a representation of a foot or a shoe.

14. A vacuum cleaner comprising:

a carriage having a left side region, a right side region spaced apart in a lateral direction from the left side region, an opening between the left side region and the right side region, a front structure joining the left side region to the right side region, and a plurality of supports configured to hold the carriage on a horizontal plane;

a nozzle mounted to the carriage, the nozzle having a lower face and a suction inlet therethrough;

a handle assembly comprising a housing that extends into the opening, a suction source inside the housing, and a dirt collection device inside or connectable to the housing;

a pivot joining the handle assembly to the carriage for rotation about a pivot axis extending in the lateral direction between the left side region and the right side region, the handle assembly being rotatable, relative to the base assembly, between a first position in which the handle assembly is generally perpendicular to the horizontal plane, and a second position in which the handle assembly is inclined relative to the horizontal plane;

an air passage system fluidly connecting the suction inlet, the suction source and the dirt collection device;

a resiliently-deformable crossbeam having a first end and a second end that are integrally formed as a unitary part with the carriage, and a fixed middle portion extending from the first end to the second end; and a protrusion integrally formed with the other of the carriage or the housing, the protrusion being positioned to abut the middle portion of the crossbeam to resiliently hold the handle assembly in the first position until an unlocking force of a predetermined magnitude is applied to cause the protrusion to deform the middle portion of the crossbeam linearly away from the opening to permit the handle assembly to move from the first position to the second position.

15. The vacuum cleaner of claim 14, wherein the unlocking force comprises a first force to rotate the housing in a first direction around the pivot axis, and a second force to rotate the carriage in a second direction around the pivot axis.

16. The vacuum cleaner of claim 14, wherein the middle portion of the resiliently-deformable crossbeam comprises a flexible spar adjacent a cavity formed in the carriage, the cavity being located such that the flexible spar flexes into the cavity when the crossbeam deforms to permit the handle assembly to move from the first position to the second position.

17. The vacuum cleaner of claim 16, wherein the cavity comprises an open slot or a closed slot.

18. The vacuum cleaner of claim 14, wherein the nozzle is movably mounted on the carriage, and the vacuum cleaner further comprises a height adjustment assembly configured to raise the nozzle relative to the carriage.

19. The vacuum cleaner of claim 14, wherein the suction source is located in a portion of the housing that extends into the opening, and a rotating axis of the suction source is collinear with the pivot axis.

20. A vacuum cleaner comprising:

a base configured to traverse a horizontal plane, the base having a downward-facing suction inlet and a resiliently-deformable crossbeam, the crossbeam having a first end and a second end that are integrally formed as a unitary part with the base, and a fixed middle portion extending from the first end to the second end;

a handle assembly pivotally mounted to the base adjacent the crossbeam, the handle assembly being rotatable about a pivot axis and movable between a first position in which the handle assembly is generally perpendicular to the base, and a second position in which the handle assembly is inclined relative to the base;

a protrusion extending from the handle assembly and positioned to abut the middle portion of the resiliently-deformable crossbeam to resiliently hold the handle assembly in the first position, the protrusion being configured to deform the middle portion of the resiliently-deformable crossbeam linearly away from the inlet to allow the handle assembly to move from the first position to the second position;

one or more rolling supports connected to one or both of the base and the handle assembly and positioned to support the base and handle assembly on a horizontal surface;

a suction source located in one of the base assembly and the handle assembly;

a dirt collection device located in one of the base assembly and the handle assembly; and an air passage system fluidly connecting the suction inlet, the suction source and the dirt collection device.

21. The vacuum cleaner of claim 20, wherein the suction inlet is in front of the pivot axis and the crossbeam is behind the pivot axis.

* * * * *